US006376773B1

(12) United States Patent
Maegawa

(10) Patent No.: US 6,376,773 B1
(45) Date of Patent: Apr. 23, 2002

(54) STRUCTURE FOR CONNECTING ELECTRICAL CABLES TO A FLAT ELECTRICAL CABLE

(75) Inventor: Akihito Maegawa, Mie (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 09/583,779

(22) Filed: May 31, 2000

(30) Foreign Application Priority Data

Jun. 1, 1999 (JP) ..... 11-154134

(51) Int. Cl.[7] ..... H01R 4/00
(52) U.S. Cl. ..... 174/88 R; 174/117 F
(58) Field of Search ..... 174/117 F, 88 R, 174/117 FF, 92, 84 R, 138 F; 439/492, 494, 498, 499

(56) References Cited

U.S. PATENT DOCUMENTS

| | | | | |
|---|---|---|---|---|
| 4,032,214 A | | 6/1977 | McNerney | |
| 5,456,791 A | | 10/1995 | Ueno | 156/556 |
| 5,708,132 A | * | 1/1998 | Grimm | 524/487 |
| 5,724,730 A | | 3/1998 | Tanaka | 29/868 |
| 5,770,818 A | | 6/1998 | Tanaka et al. | |
| 5,780,774 A | * | 7/1998 | Ichikawa et al. | 174/88 R |
| 5,827,081 A | | 10/1998 | Sakamaki | 439/164 |

FOREIGN PATENT DOCUMENTS

| | | |
|---|---|---|
| GB | 2298091 | 8/1996 |
| JP | 9167648 | 6/1997 |
| JP | 10-12049 | 1/1998 |

OTHER PUBLICATIONS

An English Language abstract of JP 9–167648.
An English Language abstract of JP 10–12049.

* cited by examiner

*Primary Examiner*—Chau N. Nguyen
(74) *Attorney, Agent, or Firm*—Greenblum & Bernstein, P.L.C.

(57) ABSTRACT

There is provided a structure for connecting individual electrical cables to a flat electrical cable. The electrical cables respectively include a core wire group exposed at an end portion thereof, and an elastic sealing material adjacent the end portion, whereas the flat electrical cable includes conductor elements at an end portion thereof, and an elastic sealing material adjacent the end portion. The core wire groups and the conductor elements are superposed thereby forming a joint section. The joint section and the elastic sealing materials are molded with an insulator resin, whereby the elastic sealing material is adhered to the outer surface of the electrical cables and the flat electrical cable by compression under the insulator resin.

20 Claims, 4 Drawing Sheets

STRUCTURE FOR CONNECTING ELECTRICAL CABLES TO A FLAT ELECTRICAL CABLE

BACKGROUND OF THE INVENTION

1. Field of the Invention

The present invention relates to a structure for connection between a flat electrical cable and individual electrical cables. More particularly, the invention concerns a water-proof connecting structure. Such a connecting structure can be used in automobile parts which receive water, and ensures the water impermeability of the joint section between the flat cable and the electrical cables.

2. Description of Background Information

Automobile doors or other parts contain wire harnesses wired thereto, while electrical cables are wired in the automobile body. The electrical cables are then led out from the car body, and connected to a flat electrical cable (sometimes referred to as "ribbon cable") wired inside the door. However, as the window glass of the door is moved up and down, inside the door, there is a possibility of water seepage into a joint section between electrical cables and a flat cable. Although there has existed a strongly felt need to improve the imperviousness of this section, the solution was found difficult to implement from a practical point of view.

FIG. 1 shows a joint section between a flat cable and corresponding electrical cables. As the figure shows, the flat cable 1 includes an end portion in which conductor elements la are exposed. Likewise, each of the electrical cables 2 includes an end portion where a core wire group 2*a* is exposed. The corresponding conductor elements la and core wire groups 2*a* are then superposed and bonded by resistance welding, ultrasonic welding, or the like. A Japanese patent application published under the publication No. HEI 9-167648 discloses a structure connecting a flat cable conductor to bus bars, as shown in FIG. 2. In this structure, the bus bars 3 and the electrical conductor 1*a* of flat cable 1 are connected, and the joint section is held by a holder 4. A hot-melt-type bonding layer is then formed on the flat cable 1 and heated, so that the conductor 1*a* and the bus bars 3 are connected by melting.

Alternatively, the bus bars 3 shown in FIG. 2 may be replaced by electrical cables 2. The conductor portion of flat cable 1 and the core wire portion of electrical cables 2 are then put together to form a joint section. Subsequently, the joint section is held by a holder, and linked with a bond. However, in this case too, the joint section is not sufficiently protected from water, and cannot be used in locations where there is frequent water seepage.

In view of the above, the main object of the present invention is to provide a water-proof structure for connecting a flat cable to electrical cables.

SUMMARY OF THE INVENTION

To this end, there is provided a structure for connecting electrical cables to a flat electrical cable, the respective electrical cables and the flat electrical cable including a coated portion, and an end portion where a conductor element is exposed from the coatings. Further, part of each of the coated portions adjacent the end portions is surrounded with a sealing material. The end portion of the respective electrical cables and that of the flat electrical cable are then superposed, thereby forming a joint section. Subsequently, the joint section and the part of each of the coated portions adjacent the end portions are molded with an insulator resin, whereby the sealing material is adhered to the coated portion of the respective electrical cables and the flat electrical cable.

The end portion of the respective electrical cables may include a group of core wires and the end portion of the flat electrical cable may include a corresponding conductor element.

Preferably, the sealing material used is an elastic material.

Suitably, the sealing material includes a butyl rubber tape wound around the respective electrical cables and the flat electrical cable.

Alternatively, the sealing material may include at least one of nitrile rubber and epichlorohydrin, and may be painted around the electrical cables and the flat electrical cable.

Further, the structure may contain a shell with grooves, the shell including the joint section held in the grooves, and being molded with an insulator resin.

In the above structure, the elastic sealing materials are adhered to the outer surface of the electrical cables and the flat electrical cable by compression under the insulator resin.

The flat electrical cable is formed by arranging conductor strips made of copper foil at a given parallel interval, and coating both faces of the strips with an insulator resin. The end portion of the flat cable is stripped of the coating, so that the conductor elements are exposed. Likewise, there is provided a number of electrical cables corresponding to that of the exposed conductor elements. The end portion of these electrical cables is stripped of the coating, so that the core wire groups are exposed. The conductor elements and the core wire groups are superposed, and bonded by ultrasonic welding, resistance welding or a similar means. The flat electrical cable and the electrical cables are then inserted into a die, and insert-molded by filling the die with the insulator resin. When the insert-molding is performed, the elastic sealing materials surrounding the electrical cables and the flat electrical cable are crushed by compression, and firmly adhered around the outer circular surface of the corresponding cables.

As the joint section between the conductor elements of the flat cable and the core wire groups of electrical cables is insert-molded, water penetration can be avoided. Likewise, even if water penetrates through the apertures formed by the cables leading out from the molded structure, it is stopped by the adhered sealing materials, so that the water cannot reach the joint section.

The joint section between the core wire groups of the electrical cables and the conductor elements of the flat electrical cable is fixedly positioned in the grooves provided in a shell, and the shell is molded with an insulator resin.

When such a shell is used, the protection of the joint section is further enforced by the rigid body of the shell, so that the electrical connections are made even more reliable.

BRIEF DESCRIPTION OF THE DRAWINGS

The above and the other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

Figure 1:
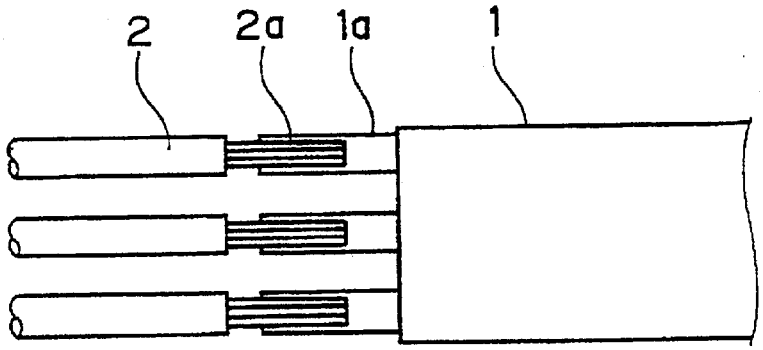
FIG. 1 PRIOR ART
FIG. 1 is a schematic view showing a known connecting structure between individual electrical cables and a flat electrical cable.
Figure 2:
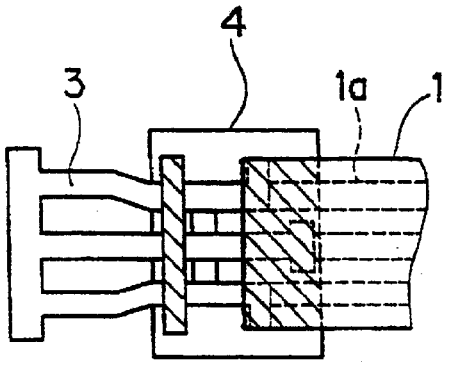
FIG. 2 PRIOR ART
FIG. 2 shows a known connecting structure between a flat cable and a bus bar.
Figure 3:
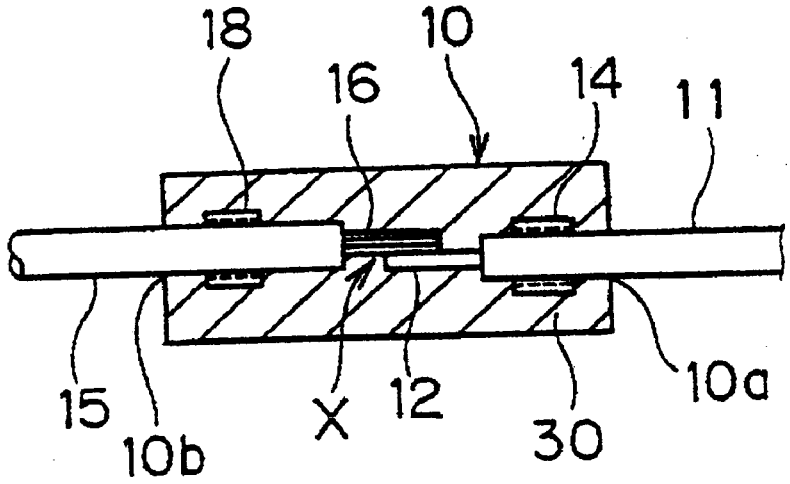
FIG. 3 is a cross-sectional side view of a connecting structure according to a first embodiment of the present invention.

A first embodiment of the present invention is shown in FIGS. 3 and 4. The connecting structure 10 shown in FIG. 3 is manufactured using a die. Suitably, the structure 10 is formed by insert-molding the joint section X which links the respective conductor elements 12 of flat cable 11 to the corresponding core wire groups 16 of electrical cables 15.

Figure 4A:
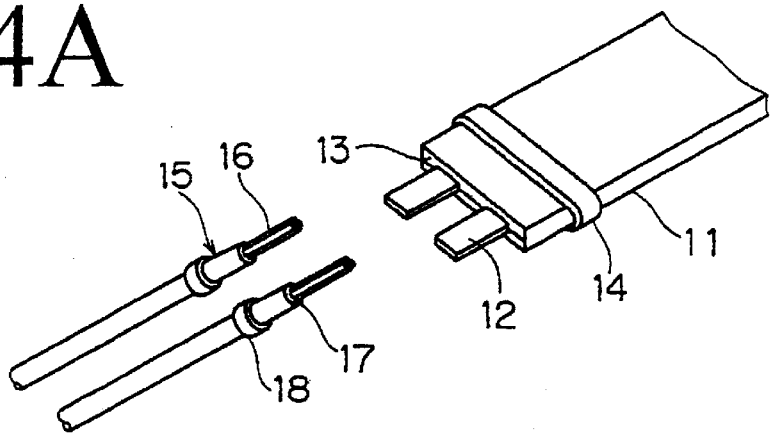
FIGS. 4A to 4D are perspective views showing how the inventive connecting structure is manufactured.

To prepare the structure 10, the end portion of the flat cable is stripped of an insulator resin film 13, so as to expose a plurality of conductor elements 12. FIG. 4A shows an example in which two conductor elements are exposed. A coated portion adjacent the stripped-off insulator resin film 13 of flat cable 11 is surrounded by a suitable first tape 14, for example, a butyl rubber tape, which is preferably an elastic sealing material. Likewise, a coated portion adjacent the stripped-off insulator coating 17 of two electrical cables 15 is wound with a second suitable tape 18, for example, a butyl rubber tape.

Figure 4B:
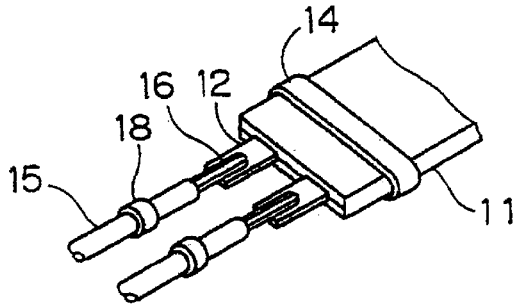

As shown in FIG. 4B, the end portion of the conductor elements 12 of flat cable 11 and that of the core wire groups 16 of electrical cables 15 are superposed and bonded by a suitable process, such as ultrasonic welding or resistance welding, to form a joint section X.

Figure 4C:
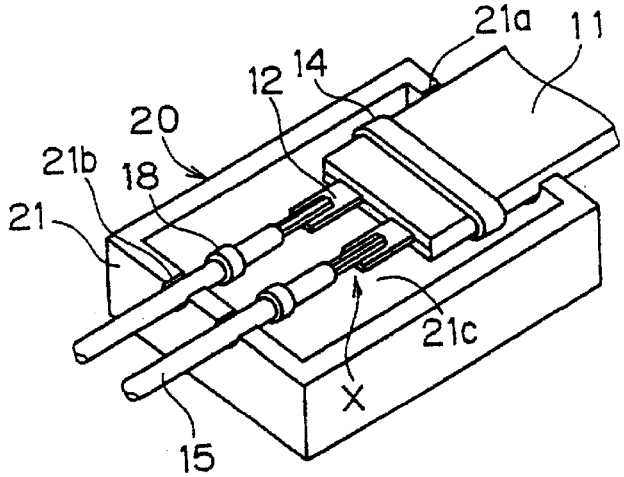

A set of dies 20 used in the present embodiment includes a top die 22 and a bottom die 21. As shown in FIG. 4C, the joint section is placed between a groove 21*a* formed in a first upper rim of bottom die 21, and grooves 21*b* formed in the opposing upper rim thereof, such that the first and the second tapes 14 and 18 wound around the flat cable 11 and the electrical cables 15, respectively, are positioned inside the bottom die 21. Preferably, the joint section X between the flat cable 11 and the electrical cables 15 is placed in the middle of the cavity 21*c* of bottom die 21.

Figure 4D:
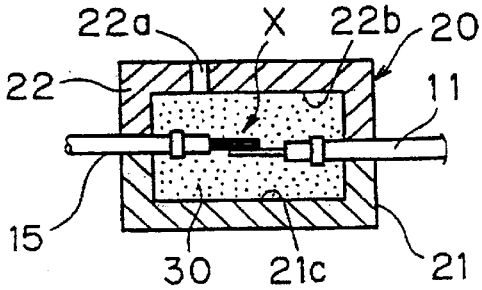

As shown in FIG. 4D, the top die 22 is put on the bottom die 21, and the dies 20 are clamped together. Subsequently, insert-molding is performed by filling the top and bottom cavities 21*c* and 22*b* with a suitable melt insulator resin 30 through a feeding orifice 22*a* formed in the top die 22.

When the insert-molding is performed, the elastic tapes 14 and 18 are compressed by the resin and its air pores are crushed. As a consequence, these tapes are compressed and adhered around the flat cable and the electrical cables, respectively. The insulator resin 30 filled in the dies 20 is then hardened, and the dies are opened. There is then obtained a connecting structure 10, which has a configuration shown in FIG. 3.

As mentioned above, the joint section X between the conductor elements 12 of flat cable 11 and the core wire groups 16 of electrical cables 15 is insert-molded with an insulator resin 30. The joint section is thus protected from direct water contact. However, the flat cable 11 and the electrical cables 15 respectively contain passage orifices 10*a* and 10*b* in the connecting structure 10 (see FIG. 3), and these orifices may receive water. Any entering water may then follow the coated surface of flat cable and electrical cables, and move towards the inside of connecting structure 10. However, the present invention has an advantage that the advance of such entering water can be stopped by the tapes 14 and 18 adhered on the coated portion. The joint section X is thus protected from water seepage.

The sealing material is preferably an elastic tape which is crushed when insert-molded. Such sealing materials may include a nitrile rubber and epichlorohydrin rubber. These sealing materials may also be painted around the coatings of flat cable 11 or electrical cables 15.

Figure 5:
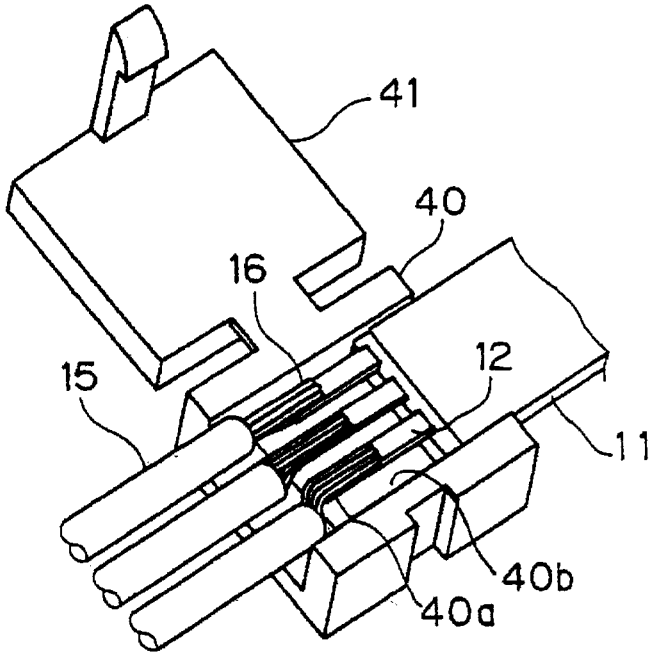
FIG. 5 is a perspective view of a shell in which the electrical cables and the flat cable are connected, according to a second embodiment of the invention.

FIG. 5 shows a second embodiment, in which the flat cable 11 and the electrical cables 15 are inserted and held in grooves 40*a* in a shell 40 of a casing. The shell 40 is provided with a space 40*b*, where the conductor elements 12 exposed at the end of flat cable 11 and the core wire groups 16 exposed at the end of electrical cables 15 are superposed and suitably joined, for example, by welding. The shell 40 is joined to a cover 41 through a hinge. In this manner, the casing contains and protects a joint section X, in which the flat cable 11 and the electrical cables 15 are fixedly held.

Figure 6:
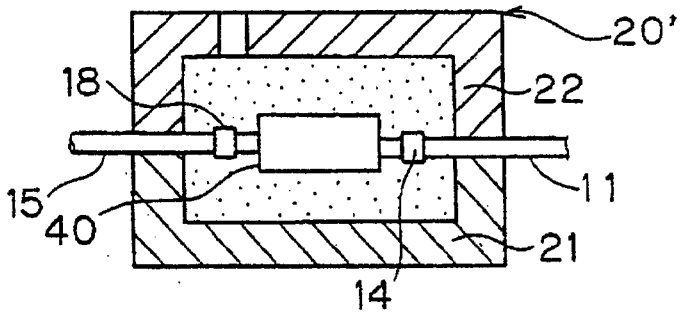
FIG. 6 is a cross-sectional side view showing a joint section contained in a die, according to the second embodiment.
Figure 7:
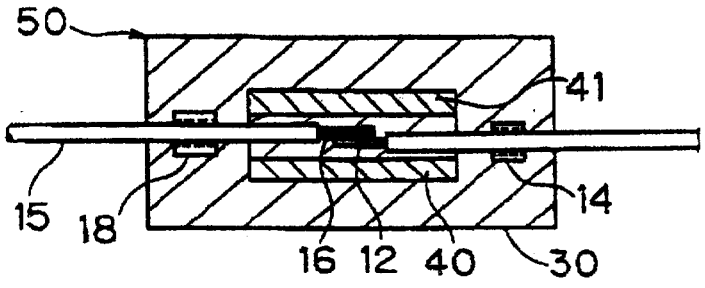
FIG. 7 is a cross-sectional view of a connecting structure according to the second embodiment.

The sealing materials 14 and 18, e.g. butyl rubber tape, are wound around, and adhered to, the flat cable 11 and the electrical cables 15 extend from the shell 40 in the same manner as in the first embodiment. As shown in FIG. 6, the entire structure is then inserted into dies 20' as in the case of the first embodiment. A melt insulator resin is then filled into the cavity of the dies 20'. The insert-molding is thus effected while the dies contain the casing. FIG. 7 shows a connecting structure 50 thus obtained.

In the structure 50 of the second embodiment, as in the structure 10 of first embodiment, the joint section X is molded with an insulator resin 30, so that water penetration is prevented. Furthermore, the flat cable 11 and the electrical cables 15 are protected by a sealing material 14 or 18 which is compressed on the outer coatings of those cables 11 and 15. In this manner, protection against water penetration is further enhanced.

According to the invention, the core wire groups exposed at the end portion of electrical cables, and the conductor elements exposed at the end portion of flat cable are connected in a joint section. The joint section is then insert-molded with an insulator resin. In addition, an elastic sealing material is wound around the respective flat and electrical cables outside the joint section. The sealing materials are crushed by compression when the insert-molding is performed, whereby they are adhered to the outer circular surface of flat cable and electrical cables. The joint section X linking the conductor elements to the core wire groups is thus molded with a resin, and protected against water infiltration. Even when water enters through apertures through which the cables extend from the connecting structure, the above-mentioned seal blocks water penetration. Water cannot thus reach the joint section linking the conductor elements to the core wire groups. The water-proof quality of the structure is thus flirter improved.

Although the invention has been described with reference to particular means, materials and embodiments, it is to be understood that the invention is not limited to the particulars disclosed and extends to all equivalents within the scope of the claims.

The present disclosure relates to subject matter contained in priority Japanese Application No. HEI 11-154134, filed on Jun. 1, 1999.

What is claimed:

1. A structure for connecting individual electrical cables to a flat electrical cable, each of the individual electrical cables and the flat electrical cable including a coated portion, and an end portion where a conductor element is exposed from the coatings, said connecting structure comprising a sealing material surrounding part of each of the coated portions adjacent the end portions, the exposed conductor elements of the individual electrical cables and the exposed conductor elements of the flat electrical cable being superposed, thereby forming a joint section; and an insulator resin molded on and completely encasing said joint section and said sealing material surrounding said of each of the coated portions adjacent the end portions of the individual electrical cables and the flat electrical cable, whereby said sealing material is adhered to the coated portions of the individual electrical cables and the flat electrical cable.

2. The structure for connecting individual electrical cables to a flat electrical cable according to claim 1, wherein the end portions of the individual electrical cables comprise a group of core wires and the end portion of the flat electrical cable comprises said conductor element.

3. The structure for connecting individual electrical cables to a flat electrical cable according to claim 2, wherein said sealing material is elastic.

4. The structure for connecting individual electrical cables to a flat electrical cable according to claim 3, wherein said sealing material comprises a tape wound around each of the individual electrical cables and the flat electrical cable.

5. The structure for connecting individual electrical cables to a flat electrical cable according to claim 4, wherein said tape comprises butyl rubber.

6. The structure for connecting individual electrical cables to a flat electrical cable according to claim 3, wherein said sealing material comprises at least one of nitrile rubber and epichlorohydrin ,and is painted around each of the individual electrical cables and the flat electrical cable.

7. The structure for connecting individual cables to a flat electrical cable according to claim 3, further comprising a shell with grooves, said joint section being held in said grooves, and said shell being molded with said insulator resin.

8. The structure for connecting individual electrical cables to a flat electrical cable according to claim 3, wherein said elastic sealing material includes air pores, said air pores being crushed by said insulator resin so that said connecting structure is waterproof.

9. The structure for connecting individual electrical cables to a flat electrical cable according to claim 2, farther comprising a shell with grooves, said joint section being held in said grooves, said shell being molded within said insulator resin.

10. The structure for connecting individual electrical cables to a flat electrical cable according to claim 1, wherein said sealing material is elastic.

11. The structure for connecting individual electrical cables to a flat electrical cable according to claim 10, wherein said sealing material comprises a tape wound around each of the individual electrical cables and the flat electrical cable.

12. The structure for connecting individual electrical cables to a flat electrical cable according to claim 11, wherein said tape comprises butyl rubber.

13. The structure for connecting individual electrical cables to a flat electrical cable according to claim 11, further comprising a shell with grooves, said joint section being held in said grooves, and said shell being molded within said insulator resin.

14. The structure for connecting individual electrical cables to a flat electrical cable according to claim 10, wherein said sealing material comprises at least one of nitrile rubber and epichlorohydrin, and is painted around each of the individual electrical cables and the flat electrical cable.

15. The structure for connecting individual electrical cables to a flat electrical cable according to claim 14, wherein said structure contains a shell with grooves, said shell including said joint section being held in said grooves, and said shell being molded within said insulator resin.

16. The structure for connecting individual electrical cables to a flat electrical cable according to claim 10, further comprising a shell with grooves, said joint section being held in said grooves, and said shell being molded within said insulator resin.

17. The structure for connecting individual electrical cables to a flat electrical cable according to claim 10, wherein said elastic sealing material includes air pores, said air pores being crushed by said insulator resin so that said connecting structure is waterproof.

18. The structure for connecting individual electrical cables to a flat electrical cable according to claim 1, further comprising a shell with grooves, said joint section being held in said grooves, and said shell being molded within said insulator resin.

19. The structure for connecting individual electrical cables to a flat electrical cable according to claim 18, wherein said connecting structure is waterproof.

20. The structure for connecting individual electrical cables to a flat electrical cable according to claim 1, wherein said connecting structure is waterproof.

* * * * *

UNITED STATES PATENT AND TRADEMARK OFFICE

CERTIFICATE OF CORRECTION

PATENT NO. : 6,376,773 B1
DATED : April 23, 2002
INVENTOR(S) : A. Maegawa et al.

It is certified that error appears in the above-identified patent and that said Letters Patent is hereby corrected as shown below:

Column 5,
Line 14, after "said", 2nd occurrence, insert -- part --.

Column 5,
Line 42, "with" should be -- within --.
Line 50, "farther" should be -- further --.

Signed and Sealed this

Twenty-first Day of January, 2003

JAMES E. ROGAN
*Director of the United States Patent and Trademark Office*